US007956541B2

(12) United States Patent
Morioka et al.

(10) Patent No.: US 7,956,541 B2
(45) Date of Patent: Jun. 7, 2011

(54) PLASMA DISPLAY PANEL HAVING FRONT PANEL WITH BISMUTH TRIOXIDE-CONTAINING DIELECTRIC LAYER

(75) Inventors: Kazuhiro Morioka, Kyoto (JP); Akira Kawase, Hyogo (JP); Yui Saitou, Osaka (JP); Shinsuke Yoshida, Hyogo (JP); Tatsuo Mifune, Osaka (JP)

(73) Assignee: Panasonic Corporation, Osaka (JP)

( * ) Notice: Subject to any disclaimer, the term of this patent is extended or adjusted under 35 U.S.C. 154(b) by 170 days.

(21) Appl. No.: 12/442,543

(22) PCT Filed: Aug. 4, 2008

(86) PCT No.: PCT/JP2008/002100

§ 371 (c)(1), (2), (4) Date: Mar. 24, 2009

(87) PCT Pub. No.: WO2009/019853

PCT Pub. Date: Feb. 12, 2009

(65) Prior Publication Data

US 2010/0084974 A1 Apr. 8, 2010

(30) Foreign Application Priority Data

Aug. 6, 2007 (JP) ..... 2007-203895
Aug. 6, 2007 (JP) ..... 2007-203896
Aug. 6, 2007 (JP) ..... 2007-203897

(51) Int. Cl.
*H01J 17/49* (2006.01)

(52) U.S. Cl. ..... 313/586; 313/587

(58) Field of Classification Search ..... 313/587, 313/586

See application file for complete search history.

(56) References Cited

U.S. PATENT DOCUMENTS

| | | | | |
|---|---|---|---|---|
| 5,977,708 | A | 11/1999 | Amatsu et al. | |
| 7,208,430 | B2 | 4/2007 | Hasegawa et al. | |
| 2001/0026255 | A1 | 10/2001 | Sano et al. | |
| 2005/0179117 | A1 * | 8/2005 | Lee | 257/650 |
| 2005/0231118 | A1 * | 10/2005 | Fujimine et al. | 313/586 |
| 2006/0276322 | A1 | 12/2006 | Hasegawa et al. | |
| 2007/0052361 | A1 | 3/2007 | Hasegawa et al. | |
| 2007/0172672 | A1 | 7/2007 | Miyazaki et al. | |
| 2007/0216306 | A1 * | 9/2007 | Kim | 313/582 |

(Continued)

FOREIGN PATENT DOCUMENTS

CN 157244 A 2/2005

(Continued)

OTHER PUBLICATIONS

U.S. Appl. No. 12/602,569.*

(Continued)

*Primary Examiner* — Nimeshkumar D Patel
*Assistant Examiner* — Glenn Zimmerman
(74) *Attorney, Agent, or Firm* — RatnerPrestia

(57) ABSTRACT

A plasma display panel is formed of a front panel including display electrodes, a dielectric layer, and a protective layer that are formed on a glass substrate, and a rear panel including electrodes, barrier ribs, and phosphor layers that are formed on a substrate. The front panel and the rear panel are faced with each other, and peripheries thereof are sealed to form a discharge space therebetween. The dielectric layer of the front panel contains $Bi_2O_3$ and at least two kinds of $R_2O$, where R is selected from the group consisting of Li, Na, and K.

6 Claims, 1 Drawing Sheet

U.S. PATENT DOCUMENTS

2008/0111487 A1* 5/2008 Choo ..... 313/586

FOREIGN PATENT DOCUMENTS

| | | | |
|---|---|---|---|
| CN | 1789190 | A | 6/2006 |
| CN | 1953942 | A | 4/2007 |
| CN | 2008800007643 | | 1/2010 |
| EP | 1 816 667 | A1 | 8/2007 |
| EP | 08 79 0364 | | 10/2010 |
| JP | 09-050769 | | 2/1997 |
| JP | 09-050769 | A | 2/1997 |
| JP | 2000-313635 | A | 11/2000 |
| JP | 2001-045877 | A | 2/2001 |
| JP | 2002-053342 | A | 2/2002 |
| JP | 2003-128430 | A | 5/2003 |
| JP | 2004-0055222 | A | 2/2004 |
| JP | 2004-307329 | | 11/2004 |
| JP | 2005-041734 | A | 2/2005 |
| JP | 2005-235735 | A | 9/2005 |
| JP | 2005-314201 | A | 11/2005 |
| JP | 2006-342018 | A | 12/2006 |
| JP | 2007-039269 | A | 2/2007 |
| JP | 2007-39269 | A | 2/2007 |
| JP | 2007-126319 | A | 5/2007 |
| JP | 2007-182365 | A | 7/2007 |
| JP | 2007-217271 | A | 8/2007 |
| JP | 2007-299641 | A | 11/2007 |
| KR | 10-2005-0077391 | | 8/2005 |
| KR | 10-2007-0051399 | | 5/2007 |
| WO | WO 2006/107051 | A1 | 10/2006 |
| WO | WO/2006/107052 | A1 | 10/2006 |

OTHER PUBLICATIONS

U.S. Appl. No. 12/442,129.*

U.S. Appl. No. 12/442,454.*

Ji-Su Park et al., "Effect of melting temperature and additives on transparency of Bi based Transparent Dielectric Layer in Plasma Display Panel", 2005 International Meeting on Information Display, Digest of Technical Papers, vol. I, First Edition, pp. 1229-1232, Korean Information Display Society, Seoul, Korea, Jul. 2005.

Joon-Young Song et al., "Preparation and characterization of CuO doped $Bi_2O_3$-$B_2O_3$-BaO-ZnO glass system for transparent dielectric layer", Journal of Non-Crystalline Solids, North-Holland Physics Publishing, vol. 352, No. 50-51, pp. 5403-5407, Dec. 1, 2006.

International Search Report for Application No. PCT/JP2008/002100., Aug. 4, 2008, Panasonic Corporation.

US Office Action for U.S. Appl. No. 12/442,454, filed Jan. 26, 2011, Panasonic Corporation.

US Office Action for U.S. Appl. No. 12/442,129, filed Oct. 28, 2010, Panasonic Corporation.

US Office Action for U.S. Appl. No. 12/442,129, filed Jan. 19, 2011, Panasonic Corporation.

International Search Report for International Application No. PCT/JP2008/002099, Sep. 2, 2008, Panasonic Corporation.

International Search Report for International Application No. PCT/JP2008/002098, Oct. 28, 2008, Panasonic Corporation.

Supplementary European Search Report for Application No. EP 08 79 0363, Oct. 8, 2010, Panasonic Corporation.

Supplementary European Search Report for Application No. EP 08 79 0362, Oct. 8, 2010, Panasonic Corporation.

Translation of Office Action for Application No. 10-2009-7006112, Oct. 19, 2010, Panasonic Corporation.

Supplementary European Search Report for Application No. EP 08 82 8889, Apr. 9, 2010, Panasonic Corporation.

Joon-Young Song et al., "Preparation and characterization of CuO doped $Bi_2O_3$-$B_2O_3$-BaO-ZnO glass system for transparent dielectric layer", Journal of Non-Crystalline Solids, North-Holland Physics Publishing, vol. 352, No. 50-51, pp. 5403-5407, Dec. 1, 2006.

Ji-Su Park et al., "Effect of melting temperature and additives on transparency of Bi based Transparent Dielectric Layer in Plasma Display Panel", 2005 International Meeting on Information Display, Digest of Technical Papers, vol. I, First Edition, pp. 1229-1232, Korean Information Display Society, Seoul, Korea, Jul. 2005.

* cited by examiner

PLASMA DISPLAY PANEL HAVING FRONT PANEL WITH BISMUTH TRIOXIDE-CONTAINING DIELECTRIC LAYER

This Application is a U.S. National Phase Application of PCT International Application PCT/JP2008/002100.

TECHNICAL FIELD

The present invention relates to a plasma display panel to be used in a display device.

BACKGROUND ART

A plasma display panel (hereinafter referred to simply as a PDP) allows achieving high definition display and a large-size screen, so that television receivers (TV) with a large screen having as great as 100 inches diagonal length can be commercialized by using the PDP. In recent years, use of the PDP in high-definition TV, which needs more than doubled scanning lines than conventional NTSC method, has progressed and the PDP free from lead (Pb) is commercialized in order to contribute environment protection.

The PDP is basically formed of a front panel and a rear panel. The front panel comprises the following elements:

- a glass substrate made of sodium-borosilicate-based float glass;
- display electrodes, formed of striped transparent electrodes and bus electrodes, formed on a principal surface of the glass substrate,
- a dielectric layer covering the display electrodes and working as a capacitor; and
- a protective layer made of magnesium oxide (MgO) and formed on the dielectric layer.

The rear panel comprises the following elements:

- a glass substrate;
- striped address electrodes formed on a principal surface of the glass substrate,
- a primary dielectric layer covering the address electrodes;
- barrier ribs formed on the primary dielectric layer; and
- phosphor layers formed between the respective barrier ribs and emitting light in red, green, and blue respectively.

The front panel confronts the rear panel such that its surface mounted with the electrodes faces a surface mounted with the electrodes of the rear panel, and peripheries of both the panels are sealed airtightly to form a discharge space therebetween, and the discharge space is partitioned by the barrier ribs. The discharge space is filled with discharge gas of Ne and Xe at a pressure ranging from 55 kPa to 80 kPa. The PDP allows displaying a color video through this method: Voltages of video signals are selectively applied to the display electrodes for discharging, thereby producing ultra-violet rays, which excite the respective phosphor layers, so that colors in red, green, and blue are emitted, thereby achieving the display of a color video.

The bus electrodes of the display electrodes employ silver electrodes in order to maintain electrical conductivity, and the dielectric layer employs low-melting glass made of mainly lead oxide. However, in recent years, dielectric layers free from lead for contributing to environment protection have been disclosed in, e.g. patent documents 1, 2, 3, and 4.

In recent years, the number of high-definition TV receivers has increased, which requires the PDP to increase the number of scanning lines, and then the number of display electrodes should be increased, so that intervals between the respective display electrodes must be reduced. As a result, the silver electrode forming the display electrode diffuses a greater amount of silver ions into the dielectric layer and the glass substrate. The diffused silver ions undergo reducing action from alkaline metal ions contained in the dielectric layer and divalent tin ions contained in the glass substrate, thereby forming silver colloid. As a result, the dielectric layer and the glass substrate tend to be yellowed or browned more noisily, and yet, silver oxide having undergone the reducing action generates oxygen which incurs air bubbles in the dielectric layer.

The increase in the number of scanning lines thus incurs yellowing in the glass substrate more noisily as well as more air bubbles in the dielectric layer, and those problems degrade the picture quality as well as generate failures in insulation of the dielectric layer.

Patent Document 1: Unexamined Japanese Patent Application Publication No. 2003-128430

Patent Document 2: Unexamined Japanese Patent Application Publication No. 2002-053342

Patent Document 3: Unexamined Japanese Patent Application Publication No. 2001-045877

Patent Document 4: Unexamined Japanese Patent Application Publication No. H09-050769

DISCLOSURE OF INVENTION

A plasma display panel (PDP) of the present invention comprising the following elements:

- a front panel including display electrodes, a dielectric layer, and a protective layer that are formed on a glass substrate; and
- a rear panel including electrodes, barrier ribs, and phosphor layers that are formed on a substrate, wherein the front panel and the rear panel are faced with each other, and peripheries thereof are sealed to form a discharge space therebetween, wherein the dielectric layer contains bismuth oxide ($Bi_2O_3$) and at least two kinds of $R_2O$ (R is selected from the group consisting of Li, Na, and K).

The foregoing structure allows reducing the content of Bi-based material, lowering a softening point of the glass for simplifying the manufacturing process, and what is more, achieving a PDP easy on the environment, allowing high-definition display, maintaining a high brightness as well as high reliability.

DESCRIPTION OF REFERENCE MARKS

Figure 1:
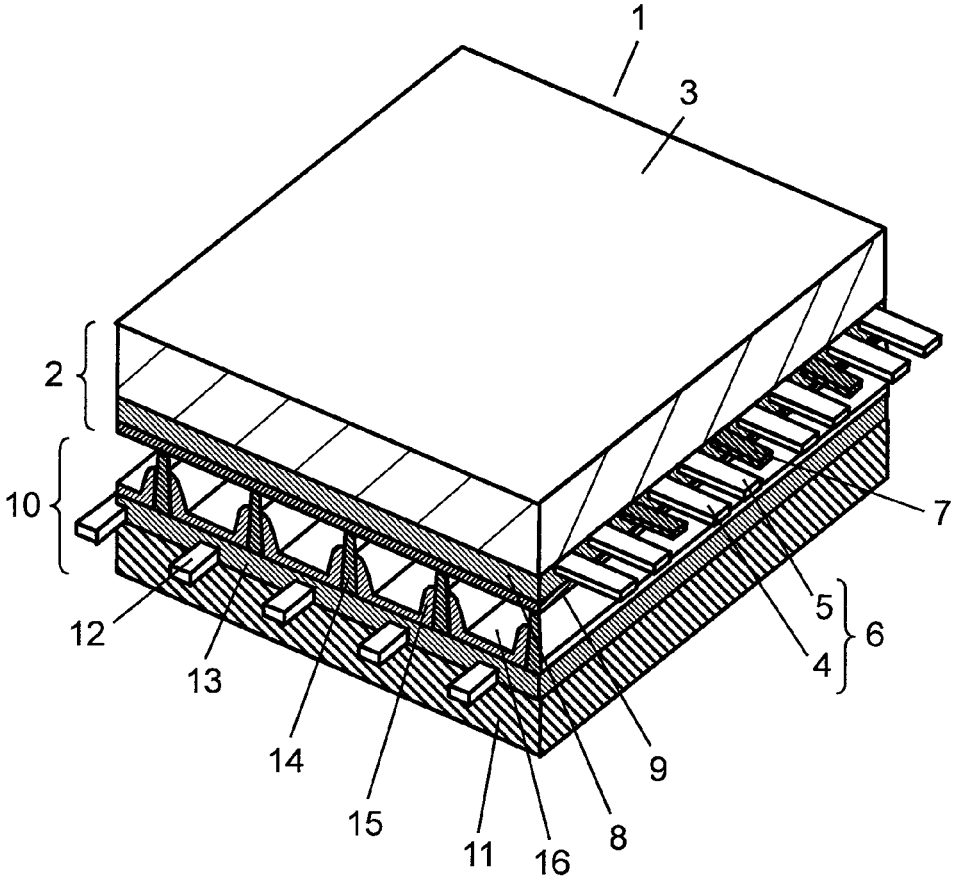
FIG. 1 shows a perspective view illustrating a structure of a PDP in accordance with an exemplary embodiment of the present invention.

1 PDP
2 front panel
3 front glass substrate
4 scan electrode
4*a*, 5*a* transparent electrode
4*b*, 5*b* metal bus electrode
5 sustain electrode
6 display electrode
7 black stripe (lightproof layer)
8 dielectric layer
9 protective layer

10 rear panel
11 rear glass substrate
12 address electrode
13 primary dielectric layer
14 barrier rib
15 phosphor layer
16 discharge space

PREFERRED EMBODIMENT OF THE INVENTION

The PDP in accordance with an exemplary embodiment of the present invention is demonstrated hereinafter with reference to the accompanying drawings.

Exemplary Embodiment

FIG. 1 shows a perspective view illustrating a structure of the PDP in accordance with the embodiment of the present invention. The PDP is basically structured similarly to a PDP of AC surface discharge type generally used. As shown in FIG. 1, PDP 1 is formed of front panel 2, which includes front glass substrate 3, and rear panel 10, which includes rear glass substrate 11. Front panel 1 and rear panel 10 confront each other and the peripheries thereof are airtightly sealed with sealing agent such as glass frit, thereby forming discharge space 16, which is filled with discharge gas of Ne and Xe at a pressure falling in a range between 55 kPa and 80 kPa.

Multiple pairs of belt-like display electrodes 6 formed of scan electrode 4 and sustain electrode 5 are placed in parallel with multiple black stripes (lightproof layer) 7 on front glass substrate 3 of front panel 2. Dielectric layer 8 working as a capacitor is formed on front glass substrate 3 such that layer 8 can cover display electrodes 6 and lightproof layers 7. On top of that, protective layer 9 made of magnesium oxide (MgO) is formed on the surface of dielectric layer 8.

Multiple belt-like address electrodes 12 are placed in parallel with each other on rear glass substrate 11 of rear panel 10, and they are placed along a direction crossing at right angles with scan electrodes 4 and sustain electrodes 5 formed on front panel 2. Primary dielectric layer 13 covers those address electrodes 12. Barrier ribs 14 having a given height are formed on primary dielectric layer 13 between respective address electrodes 12 for partitioning discharge space 16. Phosphor layers 15 are applied, in response to respective address electrodes 12, onto grooves formed between each one of barrier ribs 14. Phosphor layers 15 emit light in red, blue, and green with an ultraviolet ray respectively. A discharge cell is formed at a junction point where scan electrode 14, sustain electrode 15 and address electrode 12 intersect with each other. The discharge cells having phosphor layers 15 of red, blue, and green respectively are placed along display electrodes 6, and these cells work as pixels for color display.

Figure 2:
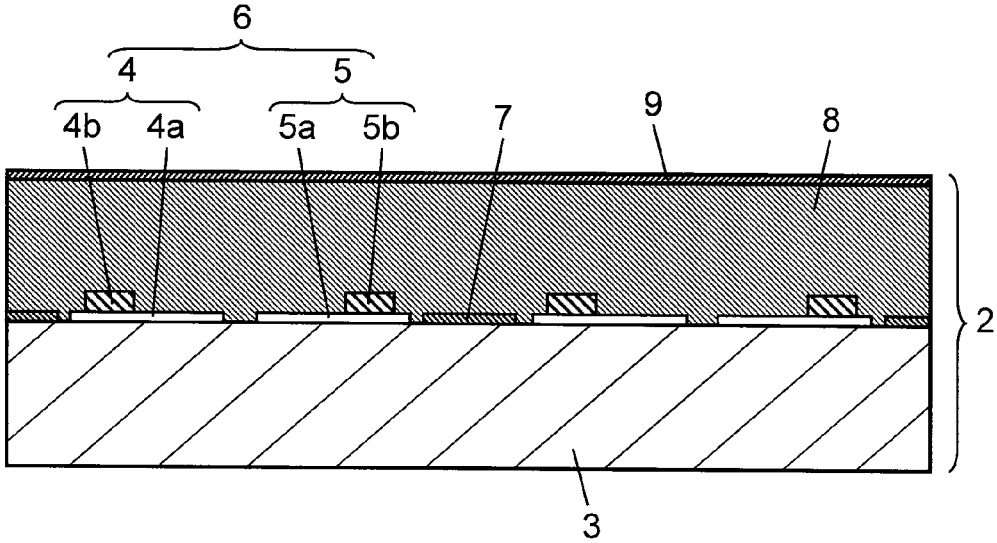
FIG. 2 shows a sectional view illustrating a structure of a front panel of the PDP shown in FIG. 1.

FIG. 2 shows a sectional view illustrating a structure of front panel 2, which includes dielectric layer 8, of the PDP in accordance with this embodiment. FIG. 2 shows front panel 2 upside down from that shown in FIG. 1. As shown in FIG. 2, display electrode 6 formed of scan electrode 4 and sustain electrode 5 is patterned on front glass substrate 3 manufactured by the float method. Black stripe 7 is also patterned together with display electrode 6 on substrate 3. Scan electrode 4 and sustain electrode 5 are respectively formed of transparent electrodes 4*a*, 5*a* made of indium tin oxide (ITO) or tin oxide ($SnO_2$), and transparent electrodes 4*b*, 5*b* employing metal bus electrodes 4*b*, 5*b* formed on electrodes 4*a*, 5*a*. Metal bus electrodes 4*b*, 5*b* give electrical conductivity to transparent electrodes 4*a*, 5*a* along the longitudinal direction of electrodes 4*a*, 5*a*, and they are made of conductive material of which main ingredient is silver (Ag).

Dielectric layer 8 covers transparent electrodes 4*a*, 5*a* and metal bus electrodes 4*b*, 5*b* and black stripes 7 formed on front glass substrate 3, and protective layer 9 is formed on dielectric layer 8.

Next, a method of manufacturing the PDP is demonstrated hereinafter. First, form scan electrodes 4, sustain electrodes 5, and lightproof layer 7 on front glass substrate 3. Scan electrode 4 and sustain electrode 5 are respectively formed of transparent electrodes 4*a*, 5*a* and metal bus electrodes 4*b*, 5*b*. These electrodes 4*a*-5*b* are patterned with a photo-lithography method. Transparent electrodes 4*a*, 5*a* are formed by using a thin-film process, and metal bus electrodes 4*b*, 5*b* are made by firing the paste containing silver (Ag) at a desirable temperature before the paste is hardened. Light proof layer 7 is made by screen-printing the paste containing black pigment, or by forming the black pigment on the entire surface of the glass substrate, and then patterning the pigment with the photolithography method before the paste is fired.

Next, apply dielectric paste onto front glass substrate 3 with a die-coating method such that the paste can cover scan electrodes 4, sustain electrodes 5, and lightproof layer 7, thereby forming a dielectric paste layer (dielectric material layer). Then leave front glass substrate 3, on which dielectric paste is applied, for a given time, so that the surface of the dielectric paste is leveled to be flat. Then fire and harden the dielectric paste layer for forming dielectric layer 8 which covers scan electrodes 4, sustain electrodes 5 and lightproof layer 7. The dielectric paste is a kind of paint containing binder, solvent, and dielectric material such as glass powder.

Next, form protective layer 9 made of magnesium oxide (MgO) on dielectric layer 8 with a vacuum deposition method. The foregoing steps allow forming a predetermined structural elements (scan electrodes 4, sustain electrodes 5, lightproof layer 7, dielectric layer 8 and protective layer 9) on front glass substrate 3, so that front panel 2 is completed.

Rear panel 10 is formed this way: First, form a material layer, which is a structural element of address electrode 12, by screen-printing the paste containing silver (Ag) onto rear glass substrate 11, or by patterning with the photolithography method a metal film which is formed in advance on the entire surface of substrate 11. Then fire the material layer at a given temperature, thereby forming address electrode 12. Next, form a dielectric paste layer on rear glass substrate 11, on which address electrodes 12 are formed, by applying dielectric paste onto substrate 11 with the die-coating method such that the layer can cover address electrodes 12. Then fire the dielectric paste layer for forming primary dielectric layer 13. The dielectric paste is a kind of paint containing binder, solvent, and dielectric material such as glass powder.

Next, apply the paste containing the material of barrier rib onto primary dielectric layer 13, and pattern the paste into a given shape, thereby forming a barrier-rib layer. Then fire this barrier-rib layer for forming barrier ribs 14. The photolithography method or a sand-blasting method can be used for patterning the paste applied onto primary dielectric layer 13. Next, apply the phosphor paste containing phosphor material onto primary dielectric layer 13 surrounded by barrier ribs 14 adjacent to each other and also onto lateral walls of barrier ribs 14. Then fire the phosphor paste for forming phosphor layer 15. The foregoing steps allow completing rear panel 10 including the predetermined structural elements on rear glass substrate 11.

Front panel 2 and rear panel 10 discussed above are placed confronting each other such that scan electrodes 4 cross with address electrodes 12 at right angles, and the peripheries of panel 2 and panel 10 are sealed with glass frit to form discharge space 16 therebetween, which is filled with discharge gas including Ne, Xe. PDP 1 is thus completed.

Next, dielectric layer 8 of front panel 2 is detailed hereinafter. Dielectric layer 8 needs a high dielectric strength, and yet, it needs a high light transmittance. These properties largely depend on the composition of the glass component contained in layer 8. A conventional way of forming dielectric layer 8 is this: Paste is applied to front glass substrate 3, on which display electrodes 6 are formed, with the screen-printing method or the die-coating method. The paste contains glass powder component and binder component formed of solvent including resin, plasticizer, and dispersant. Front glass substrate 3 is then dried and fired at 450-600° C. This paste is applied onto a film, and dried, then transcribed onto front glass substrate 3, on which display electrodes 6 have been formed, before it is fired at 450-600° C.

The glass component of layer 8 has contained lead oxide (PbO) more than 15 mole % in order to allow the firing at 450-600° C. However, in recent years, lead-free glass has been available for the purpose of environment protection, and this glass contains bismuth oxide ($Bi_2O_3$) instead of lead oxide, and the content expressed in mole % of $Bi_2O_3$ falls in a range from 5 to 40%.

The PDP in accordance with this embodiment of the present invention contains not only $Bi_2O_3$ in its dielectric layer but also at least two kinds of $R_2O$ (R is selected from the group consisting of Li, Na, and K), and the content expressed in mole % of $R_2O$ falls in a range from 1 to 9%. The content expressed in mole % of $Bi_2O_3$ desirably falls in a range from 1 to 5%. On top of that, the dielectric layer desirably contains CaO, BaO, CoO, CuO and $MoO_3$.

The dielectric material containing the foregoing composition is grinded by a wet jet mill or a ball mill into powder of which average particle diameter is 0.5 μm-3.0 μm. Next, this dielectric powder of 50-65 wt % and binder component of 35-50 wt % are mixed with a three-roll mill, so that dielectric paste to be used in the die-coating or the printing can be produced.

The binder component is formed of terpinol or butyl carbitol acetate which contains ethyl-cellulose or acrylic resin in 1 wt %-20 wt %. The paste can contain, upon necessity, plasticizer such as dioctyl phthalate, dibutyl phthalate, triphenyl phosphate, tributyl phosphate, and dispersant such as glycerop mono-oleate, sorbitan sesquio-leate, alkyl-allyl based phosphate for improving the printing performance.

Next, the dielectric paste discussed above is applied to front glass substrate 3 with the die-coating method or the screen-printing method such that the paste covers display electrodes 6, before the paste is dried. The paste is then fired at 575-590° C. a little bit higher than the softening point of the dielectric material.

A brightness of PDP advantageously increases and a discharge voltage also advantageously lowers at a thinner film thickness of dielectric layer 8, so that the film thickness is desirably set as thin as possible insofar as the insulating voltage is not lowered. Considering these conditions and a visible light transmittance, the film thickness of dielectric layer 8 is set not greater than 41 μm in this embodiment.

Use of the foregoing dielectric layer 8 allows the PDP in accordance with this embodiment to maintain a high brightness as well as high reliability in the high-definition display application, and on top of that, the PDP easy on the environment is achievable.

The material composition of dielectric layer 8 of the PDP in accordance with this embodiment is detailed hereinafter. First, the content of $Bi_2O_3$ and the addition of $R_2O$ are described. In this embodiment, $Bi_2O_3$ is employed as a replacement of lead component in dielectric glass. Increasing the content of $Bi_2O_3$ in the dielectric glass will lower the softening point of the dielectric glass, and this property produces various advantages in the manufacturing process. However, since Bi-based material is expensive, increasing the content of $Bi_2O_3$ will boost the material cost.

On the other hand, decreasing the content of Bi-based material will raise the softening point of the dielectric glass, and the firing thus should be done at a higher temperature, which will prompt the silver electrodes forming the display electrodes to diffuse silver ions in a greater amount. An amount of colloidal silver thus becomes greater, which incurs coloring of the dielectric layer or producing air-babbles, and resultantly degrades the picture quality of the PDP or a failure in insulating the dielectric layer.

The present invention focuses on Li, Na, K, Rb, or Cs selected from alkali metals as a replacement of Bi-based material. If the dielectric glass contains some alkali metal oxide, the softening point of the glass lowers, so that the content of Bi-based material can be reduced, and what is more, the softening point of the glass is lowered, thereby benefiting the manufacturing process in various ways.

However, if the glass contains too much amount of alkali metal oxide, the reduction of sliver ions, which diffuses from the silver electrodes forming the display electrodes, is accelerated, so that colloidal silver is formed in a greater amount. As a result, coloring of the dielectric layer or the production of air-bubbles occurs, which incurs degradation in picture quality of the PDP or a failure in insulation of the dielectric layer.

In this embodiment, the content expressed in mole % of $R_2O$ in the glass falls within a range of 1-9% because the content over 1% will suppress the yellowing of the dielectric layer while the content over 9% will vary a dielectric constant greatly for producing failures in displaying a video. The content expressed in mole % of $Bi_2O_3$ can be reduced to as low as 1-5%.

What is more in this embodiment, two or more than two "R"s of $R_2O$ (R is the one selected from Li, Na, K) are contained in dielectric layer 8 because of the following reason: front glass substrate 3, in general, contains much of $K_2O$ and $Na_2O$, and the firing of dielectric layer 8 at a high temperature, e.g. not lower than 550° C., prompts the $R_2O$ contained in the dielectric glass to exchange alkali metal ions ($Li^+$, $Na^+$, $K^+$) with $Na_2O$ contained in front glass substrate 3, namely, ion-exchange occurs.

Each one of those alkali metal ions ($Li^+$, $Na^+$, $K^+$) influences differently to the thermal expansion coefficient of glass substrate 3, so that the ion-exchange occurring during the firing of dielectric layer 8 will make difference in thermally contracted amount between front glass substrate 3 around dielectric layer 8 and the other parts of glass substrate 3. As a result, front glass substrate 3 produces a large warp on its surface where dielectric layer 8 is formed.

This embodiment of the present invention; however, contains two or more than two $R_2O$ in dielectric layer 8, so that the difference in thermally contracted amount hardly occurs even when the firing produces the ion-exchange, thereby reducing the warp of front glass substrate 3. As a result, not only the amount of $Bi_2O_3$ in mole % can be reduced as little as not greater than 5%, but also the warp of front glass substrate 3 can be reduced.

Next, the type and the amount of $R_2O$ to be added are detailed hereinafter. The oxide to be added as $R_2O$ must include $K_2O$, and preferably includes either one of $Li_2O$ or $Na_2O$, or both of $Li_2O$ and $Na_2O$. The oxide discussed above allows preventing the thermal expansion coefficient of front glass substrate 3 from varying greatly even if the ion-exchange occurs. As a result, a large warp of substrate 3 where dielectric layer 8 is formed can be prevented.

A greater content expressed in mole % of $K_2O$ in the dielectric glass than the total content of Lit and $Na_2O$ in the dielectric glass positively reduces a change in the thermal expansion coefficient of front glass substrate 3, and thus reduces the warp of glass substrate 3.

As discussed above, $R_2O$ indeed allows lowering the softening point of the dielectric glass, but the alkali metal oxide represented by $R_2O$ accelerates the reducing action of silver ions diffused from the silver electrodes forming display electrodes 6. A more amount of colloidal silver is thus produced, which incurs coloring of dielectric layer 8 as well as production of air bubbles in layer 8. As a result, the picture quality of the PDP is degraded, or a failure in insulating dielectric layer 8 occurs.

In order to suppress the reducing action of silver ions due to the presence of $R_2O$, this embodiment of the present invention adds CuO and CaO to the dielectric glass. On top of that, $MoO_3$ is added for decreasing the amount of colloidal silver. The works of those additives are demonstrated hereinafter.

First, CuO is reduced to $Cu_2O$ during the firing of dielectric layer 8, thereby suppressing the reducing action of silver ions ($Ag^+$). As a result, yellowing of layer 8 can be suppressed. On the other hand, CuO is found permitting the dielectric glass to color in blue while $Cu_2O$ permits the dielectric glass to color in green, so that the causes of these colorings should be clarified as discussed in the following paragraphs for solving these coloring problems.

The manufacturing of PDPs needs multiple firing steps including an assembly step. The reduction of CuO into $Cu_2O$ is subject to the atmospheric condition such as oxygen density during the firing, and it is hard to control a degree of the reduction. These properties of the reduction invite variation in coloring the surface of PDP because much progress in the CuO reduction permits a part of the surface to color in blue rather strongly while less progress in the CuO reduction permits another part of the surface to color in green strongly. This variation in coloring incurs unevenness in brightness as well as in chromaticity, so that the picture quality is degraded.

Thus CoO is added to the dielectric glass in order to suppress the foregoing variation in coloring due to the reduction of CuO. This CoO also effects coloring the dielectric glass in blue as CuO does; however, the addition of CoO allows the dielectric glass to color in blue more steadily, so that the picture quality of the PDP can be improved.

If the total amount of the additives of CuO and CoO exceeds 0.3 mole %, the dielectric glass colors in blue too strongly, so that the picture quality of PDP is degraded contrary to the expectation. If CoO is added solely to the dielectric glass, the reduction of the silver ions cannot be suppressed, and what is worse, the visible light transmittance of dielectric layer 8 is lowered. If the total amount of the additives of CuO and CoO is not greater than 0.3 mole %, the dielectric glass colors in blue optimally, so that excellent picture quality of PDP can be expected.

Next, an amount of CaO to be added is described hereinafter. As discussed previously, CaO allows suppressing the reduction of silver ions ($Ag^+$), thereby decreasing the yellowing. CaO works here as an oxidizing agent. The dielectric glass containing CaO unfortunately lowers the visible light transmittance, in particular, the linear transmission that affects a degree of the definition of display. This embodiment of the present invention thus replaces CaO in parts with BaO which is expected to increase the linear transmission.

However, BaO accelerates the reduction of the silver ions ($Ag^+$) and incurs the yellowing. It is thus important to add BaO less than the amount of CaO in mole %, so that the addition of BaO can prevent the yellowing with the linear transmittance maintained.

Next, an addition of $MoO_3$, which suppresses the production of colloidal silver as discussed previously, is described hereinafter. The addition of $MoO_3$ to the dielectric glass containing $Bi_2O_3$ tends to produce a stable chemical compound, such as $Ag_2MoO_4$, $Ag_2Mo_2O_7$, $Ag_2Mo_4O_{13}$, at a temperature as low as not higher than 580° C.

In this embodiment, since dielectric layer 8 is fired at a temperature ranging from 550 to 590° C., the silver ions ($Ag^+$) diffused into layer 8 during the firing reacts with $MoO_3$ in layer 8, thereby producing a stable compound, and thus the silver ions become stable. In other words, the silver ions ($Ag^+$) are stabilized without the reduction thereof, so that no cohering colloidal silver is produced. Oxygen production associated with the production of colloidal silver thus becomes small, so that only a small amount of air-bubbles is produced in dielectric layer 8. $MoO_3$ can be replaced with $WoO_3$, $CeO_2$, or $MnO_2$ which is added instead with the advantage similar to what is discussed above maintained.

A content expressed in mole % of $MoO_3$ preferably falls within a range from not lower than 0.1 to not greater than 2%. The content of over 0.1% allows improving the number of air-bubbles and the yellowing; however, the content of over 2% will crystallize the dielectric glass during the firing thereof. As a result, the dielectric glass becomes cloudy and cannot maintain its transparence, and the visible light transmittance thus lowers, which degrades the picture quality of the PDP. The content of less than 2%, on the other hand, makes the dielectric glass resist being crystallized, so that no degradation in the picture quality is expected.

The foregoing composition of dielectric layer 8 of PDP in accordance with the embodiment allows suppressing the yellowing as well as air-bubble production even when dielectric layer 8 is formed on metal bus electrodes 4*b*, 5*b* made of silver (Ag), and yet the foregoing structure allows suppressing the warp of the front glass substrate. On top of that, dielectric layer 8 having the foregoing structure allows the dielectric glass to achieve a high light transmittance as well as to be colored uniformly. The PDP of high light transmittance and having little yellowing and few air-bubbles is thus achievable.

A PDP, of which discharge cells have the following physical dimensions, is produced to be adaptable to a 42-inch high-definition TV.

height of barrier rib: 0.15 mm interval between barrier ribs (cell pitch): 0.15 mm interval between display electrodes: 0.06 mm The foregoing discharge cell is filled with Ne—Xe based mixed gas in which Xe gas is contained at 15 volume-content % under the pressure of 60 kPa. The PDP discussed above is used in the following experiments with the composition of the dielectric layer being varied.

EXAMPLE 1

Table 1 shows the material composition of the dielectric glass of dielectric layer 8.

TABLE 1

| Dielectric glass Composition mole % | Exp. 1 | Exp. 2 | Comp. 1 | Comp. 2 | Comp. 3 | Comp. 4 | Comp. 5 | Comp. 6 | Comp. 7 | Comp. 8 | Comp. 9 |
|---|---|---|---|---|---|---|---|---|---|---|---|
| $Bi_2O_3$ | 3.0% | 3.0% | 3.0% | 3.0% | 3.0% | 3.0% | 3.0% | 3.0% | 3.0% | 3.0% | 3.0% |
| CaO | 3.0% | 3.0% | 4.0% | 2.0% | 1.0% | 3.0% | 3.0% | 3.0% | 3.0% | 3.0% | 3.0% |
| BaO | 1.0% | 1.0% | — | 2.0% | 3.0% | 1.0% | 1.0% | 1.0% | 1.0% | 1.0% | 1.0% |
| $K_2O$ | 5.0% | 5.0% | 7.0% | 5.0% | 5.0% | 5.0% | — | 2.0% | 5.0% | 5.0% | 5.0% |
| $Na_2O$ | 2.0% | 2.0% | — | 2.0% | 2.0% | 2.0% | 2.0% | 4.0% | 2.0% | 2.0% | 2.0% |
| $Li_2O$ | — | — | — | — | — | — | 5.0% | 1.0% | — | — | — |
| CoO | 0.1% | 0.1% | — | — | — | 0.2% | 0.1% | 0.1% | 0.1% | 0.2% | — |
| CuO | 0.1% | 0.2% | 0.3% | 0.3% | 0.3% | 0.3% | 0.2% | 0.2% | 0.2% | — | — |
| $MoO_3$ | 0.7% | 0.7% | 0.7% | 0.7% | 0.7% | 0.7% | 0.7% | 0.7% | 2.5% | 0.7% | 0.7% |
| Others | 85.1% | 85.0% | 85.0% | 85.0% | 85.0% | 84.8% | 85.0% | 85.0% | 83.2% | 85.1% | 85.3% |

Exp: experiment, Comp: comparison

The PDP is produced, of which dielectric layer 8 includes the dielectric glass having the material composition shown in table 1. The bottom line shows "Others" indicating other materials free from lead, such as zinc oxide (ZnO), boron oxide ($B_2O_3$), silicon dioxide ($SiO_2$), aluminum oxide ($Al_2O$), and they are not specified their contents, which though fall within the range specified by conventional art.

To evaluate the properties of the PDP formed of the foregoing dielectric glass, the PDP is tested for the following items. The test result is shown in table 2.

TABLE 2

| | Exp. 1 | Exp. 2 | Comp. 1 | Comp. 2 | Comp. 3 | Comp. 4 | Comp. 5 | Comp. 6 | Comp. 7 | Comp. 8 | Comp. 9 |
|---|---|---|---|---|---|---|---|---|---|---|---|
| Linear transmittance (%) | 71.2 | 73.6 | 67.7 | 82.7 | 74.5 | 71.9 | 71.7 | 71.4 | 55.8 | 69.2 | 70.0 |
| yellowing (b* value) Aver | 1.8 | 1.7 | 1.8 | 5.6 | 2.6 | 1.8 | 2.1 | 2.0 | 2.0 | 1.9 | 6.2 |
| Max. | 2.0 | 2.0 | 2.3 | 6.1 | 3.4 | 2.1 | 2.3 | 2.2 | 2.3 | 2.1 | 6.4 |
| Wavelength dependency (%) | 1.0 | 1.9 | 2.1 | 1.7 | 1.8 | 3.1 | 1.4 | 1.5 | 1.3 | 1.1 | 0.9 |
| Residual stress (MPa) | −0.8 | −0.7 | −1.0 | −0.4 | −0.6 | −0.7 | 3.4 | 1.5 | −0.7 | −0.8 | −0.9 |

First, the transmittance of front panel 2 is measured with a Haze Meter. The measurement results are deducted other factors, e.g. the transmittance of front glass substrate 3 and scan electrodes 4, then the practical results are used as the transmittance of dielectric layer 8. The linear component of this practical transmittance, i.e. the linear transmittance, is compared with the comparisons 1-9. The linear transmittance is preferably over 70%, and less than 70% is not preferable because it will lower the brightness of PDP.

A degree of yellowing is measured with a colorimeter (made by Konica-Minolta Inc. Model No. CR-300) for obtaining b* values at nine points in the surface of PDP. The average and the max. values of the b* values are used for the comparisons. The comparison result is shown in table 2. The b* value indicates how much the yellowing affects the display performance of PDP, and the threshold is b*=3. The yellowing becomes more conspicuous at a greater value of b*, and the color temperature lowers accordingly, which is not favorable to the PDP.

Next, the transmittance of front panel 2 is measured with a spectrophotometric colormetry meter (made by Konica-Minolta Inc. Model No. CM-3600) in order to evaluate a degree of pigmentation of the dielectric material. The measurement results are deducted other factors such as the transmittance of front glass substrate 3 and scan electrodes 4, then the practical results are used as the transmittance of dielectric layer 8. On top of that, a transmittance at wavelength of 550 nm is deducted a transmittance at wavelength of 660 nm, and this deduction result is used for the comparisons as a wavelength dependency. The wavelength dependency of the PDP is preferably not greater than 2%, and if it exceeds 2%, a degree of whiteness of the front panel will lower, which is not favorable to the PDP.

The substrate is measured residual stress with a polariscope in order to evaluate a warp thereof due to the presence of the dielectric glass. The polariscope can measure the residual stress in front glass substrate 3 due to distortion caused by the glass component. This measuring method is disclosed in, e.g. Unexamined Japanese Patent Application Publication No. 2004-067416, and the method is thus well known. The measured residual stress is expressed in table 2 with a plus symbol (+) when compression stress exists in front glass substrate 3, and with a minus symbol (−) when tensile stress exists in substrate 3. The PDP preferably has residual stress expressed with the minus symbol (−) because if it has plus (+) residual stress, then the tensile stress occurs in dielectric layer 8, so that the strength of layer 8 lowers.

The result shown in table 2 is described here. The linear transmittances of comparisons 1, 7 and 8 are less than 70% because of no BaO, too much $MoO_3$, or no CuO as shown in table 1. Comparison 2 has a rather high linear transmittance 82.7%; however, its b* value is as high as 5.6, which is not favorable, because of too much BaO included. Comparison 3 contains no CoO as shown in table 1, so that average of b* value is 2.6, i.e. less than 3.0, however, max. of b* value is 3.4, which makes the dispersion too wide, and it is not favorable to PDP. Comparison 4 contains CoO and CuO in total as much as 0.5%, so that the wavelength dependency of the transmittance is as much as 3.1%, which is not favorable. Comparisons 5, 6 include no $K_2O$ as shown in table 1, or the amount of $K_2O$ is less than the total amount of $Na_2O$ and $Li_2O$, so that the value of residual stress is not favorable. Comparison 9 does not contain CuO or CoO as shown in table 1, so that its b* value is great, which is not favorable to PDP.

Experiments 1 and 2 of the PDP employing foregoing dielectric layer 8 include the dielectric glass of a proper material composition, so that the favorable evaluations are obtained as shown in table 2.

As discussed above, the exemplary embodiment of the present invention achieves dielectric layer 8 having a high linear transmittance of visible light as well as an optimum b* value, and suppresses a warp of the substrate, thereby obtaining the PDP free from lead and easy on the environment.

EXAMPLE 2

How much the contents of $Bi_2O_3$ and $R_2O$ in the dielectric glass affect the yellowing is studied in detail hereinafter. Table 3 shows the material composition of the dielectric glass of dielectric layer 8 used in this experiment 2. Table 3 also shows b* values measured with the colorimeter (made by Konica-Minolta, Model No. CR-300). The b* value indicates how much the yellowing affects the display performance of PDP, and the threshold is b*=3. The yellowing becomes more conspicuous at a greater value of b*, and the color temperature lowers accordingly, which is not favorable to the PDP.

TABLE 3

| | Exp. 1 | Exp. 2 | Exp. 3 | Comp. 1 | Comp. 2 |
|---|---|---|---|---|---|
| $Bi_2O_3$ Composition of dielectric (mole %) | 3.1% | 1.0% | 3.7% | 0% | 5.2% |
| $R_2O$ Composition of dielectric (mole %) | 8.6% | 7.8% | 4.0% | 9.3% | 0% |
| Yellowing (b* value) Average | 1.8 | 2.7 | 1.2 | 5.1 | 7.0 |

In table 3, comparison 1 contains no $Bi_2O_3$ but much $R_2O$, so that its b* value becomes as great as 5.1, while comparison 2 includes some $Bi_2O_3$ but no $R_2O$, so that its b* value becomes also as great as 7.0.

On the other hand, the dielectric glasses used in experiments 1, 2 and 3 contain $Bi_2O_3$ and $R_2O$ according to the description of the exemplary embodiment of the present invention, and they result in favorable evaluations. The inventors have studied a lower limit of the content of $R_2O$, and found that the content of at least 1% allows lowering the softening point of the dielectric glass with the warp of substrate being suppressed.

The exemplary embodiment of the present invention thus proves that the PDP having an optimal b* value, and yet, being free from lead as well as easy on the environment is achievable.

INDUSTRIAL APPLICABILITY

The PDP of the present invention is free from yellowing in the dielectric layer, and easy on the environment, and excellent in display quality, so that it is useful as a display device of a large-size screen.

The invention claimed is:

1. A plasma display panel comprising:

a front panel including display electrodes, a dielectric layer, and a protective layer that are formed on a glass substrate; and a rear panel including electrodes, barrier ribs, and phosphor layers that are formed on a substrate, wherein the front panel and the rear panel are faced with each other, and peripheries thereof are sealed to form a discharge space therebetween, wherein the dielectric layer of the front panel contains $Bi_2O_3$; at least two kinds of $R_2O$ where R is selected from the group consisting of Li, Na and K; CaO; BaO; CoO; CuO and $MoO_3$, wherein the total amount of CuO and CoO does not exceed 0.3 mole %.

2. The plasma display panel of claim 1, wherein a total amount of contents expressed in mole % of the at least two kinds of $R_2O$, where R is selected from the group consisting of Li, Na and K, falls in a range from 1% to 9%.

3. The plasma display panel of claim 2, wherein one of the at least two kinds of $R_2O$ is $K_2O$, where R is selected from the group consisting of Li, Na and K.

4. The plasma display panel of claim 3, wherein a content expressed in mole % of $K_2O$ is greater than a total amount of contents of $Li_2O$ and $Na_2O$ in the dielectric layer.

5. The plasma display panel of claim 1, wherein a content expressed in mole % of $Bi_2O_3$ falls in a range from 1% to 5%.

6. The plasma display panel of claim 1, wherein a content expressed in mole % of $MoO_3$ falls in a range from 0.1% to 2%.

* * * * *